US011150009B2

(12) United States Patent
Zhu et al.

(10) Patent No.: US 11,150,009 B2
(45) Date of Patent: Oct. 19, 2021

(54) WATER STORAGE DEVICE AND REFRIGERATOR HAVING THE SAME

(71) Applicant: QINGDAO HAIER CO., LTD., Qingdao (CN)

(72) Inventors: Xiaobing Zhu, Qingdao (CN); Yanqing Zhang, Qingdao (CN); Jianjun Xue, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 0 days.

(21) Appl. No.: 16/754,101

(22) PCT Filed: Nov. 15, 2018

(86) PCT No.: PCT/CN2018/115571
§ 371 (c)(1),
(2) Date: Apr. 6, 2020

(87) PCT Pub. No.: WO2019/120010
PCT Pub. Date: Jun. 27, 2019

(65) Prior Publication Data

US 2020/0333066 A1 Oct. 22, 2020

(30) Foreign Application Priority Data

Dec. 23, 2017 (CN) ..... 201711407449.X

(51) Int. Cl.
*F25D 23/12* (2006.01)
*B67D 1/00* (2006.01)

(52) U.S. Cl.
CPC ..... *F25D 23/126* (2013.01); *B67D 1/0009* (2013.01); *B67D 1/0014* (2013.01)

(58) Field of Classification Search
CPC ..... F25D 23/126; F25D 23/12; F24H 4/02; B67D 1/0009; B67D 1/0014
USPC ..... 62/314, 338, 389, 391, 430; 141/23, 26, 141/27
See application file for complete search history.

(56) References Cited

U.S. PATENT DOCUMENTS 3,982,406 A * 9/1976 Hanson ..... F25D 23/126 62/339
RE33,222 E * 5/1990 Zebuhr ..... F24D 17/00 126/374.1
5,121,612 A * 6/1992 Guay ..... B67D 3/0029 222/146.6

(Continued)

FOREIGN PATENT DOCUMENTS

CN 201059741 Y 5/2008
CN 103604268 A 2/2014

(Continued)

*Primary Examiner* — Timothy L Maust
(74) *Attorney, Agent, or Firm* — Cheng-Ju Chiang

(57) ABSTRACT

A water storage device and a refrigerator, the water storage device comprising: a housing having a water inlet end and a water outlet end, and a water distribution plate. The water distribution plate divides a water storage cavity into a water inlet cavity and a water outlet cavity; a gap for allowing water to flow through is provided between the outer edge of the water distribution plate and the inner wall of the housing; when the water distribution plate moves from the water inlet end towards the water outlet end, water entering the water inlet cavity from the water inlet end will not mix with cold water in the water outlet cavity.

10 Claims, 7 Drawing Sheets

(56) References Cited

U.S. PATENT DOCUMENTS

| | | | | |
|---|---|---|---|---|
| 5,315,845 | A * | 5/1994 | Lee | B67D 1/0858 165/170 |
| 6,367,713 | B1 * | 4/2002 | Robinson | B05B 17/085 239/170 |
| 6,622,509 | B2 * | 9/2003 | Stich | F25D 23/126 62/318 |
| 8,640,481 | B2 * | 2/2014 | An | F25D 25/025 62/338 |
| 8,726,685 | B2 * | 5/2014 | An | B29C 45/00 62/338 |
| 8,833,100 | B2 * | 9/2014 | Meyerholtz | F25D 23/126 62/318 |
| 2010/0229592 | A1 | 9/2010 | Lim et al. | |

FOREIGN PATENT DOCUMENTS

| | | | |
|---|---|---|---|
| CN | 105115159 | A | 12/2015 |
| CN | 105890167 | A | 8/2016 |
| CN | 108317804 | A | 7/2018 |

* cited by examiner

WATER STORAGE DEVICE AND REFRIGERATOR HAVING THE SAME

The present application is a 35 U.S.C. § 371 National Phase conversion of International (PCT) Pat. Appl. No. PCT/CN2018/115571, filed on Nov. 15, 2018, which claims priority to Chinese Patent Application No. 2017/11407449.X, filed to the Chinese Patent Office on Dec. 23, 2017 and titled "WATER STORAGE DEVICE AND REFRIGERATOR HAVING THE SAME", the content of which is incorporated herein by reference in its entirety. The PCT International Patent Application was filed and published in Chinese.

TECHNICAL FIELD

The present invention relates to the field of refrigerating devices and in particular to a water storage device which is capable of preventing incoming water entering a water inlet cavity from a water inlet end from mixing with water in a water outlet cavity in the water storage device when a user takes and use water, and a refrigerator having the water storage device.

BACKGROUND

Part of current refrigerators have a water taking function to provide the user with cold water. Specifically, the refrigerator comprises a water storage device disposed in a refrigerating compartment and configured to supply the water in the water storage device with cold in the refrigerating compartment. When the user needs to take cold water, he opens a solenoid valve of a water outlet end of the water storage device, and the cold water in the water storage device, pushed by a pressure of water entering the water inlet end from an externally-connected water supply, flows out of the water outlet end so that the user can take and use water directly.

However, the pressure of tap water is generally large, so a water flow rate at the water inlet end of the water storage device is large and normal-temperature water at a high temperature entering the water storage device quickly mixes with the cold water in the water storage device, thereby causing the temperature of water in the water storage device to rise so that the user cannot take cold water at a desired temperature.

In view of the above problems, it is necessary to provide an improved water storage device and a refrigerator having the same to solve the above problem.

SUMMARY

An object of the present invention is to provide a water storage device which is capable of preventing incoming water entering a water inlet cavity from a water inlet end from mixing with water in a water outlet cavity in the water storage device when a user takes water, and a refrigerator having the water storage device.

To achieve the above object, the present invention employs the following technical solutions:

A water storage device, comprises:

a housing forming a water storage cavity and having a water inlet end and a water outlet end disposed opposite to the water inlet end;

a water distribution plate disposed in the water storage cavity and configured to divide the water storage cavity into a water inlet cavity towards the water inlet end and a water outlet cavity towards the water outlet end, a gap allowing water to flow through being provided between the outer edge of the water distribution plate and the inner wall of the housing; when water enters from the water inlet end, the incoming water drives the water distribution plate to move towards the water outlet end;

a driving member configured to drive the water distribution plate to return to the water inlet end after the water distribution plate moves toward the water outlet end.

As a further improved technical solution of the present invention, the driving member is a spring connecting the water distribution plate with the water inlet end and/or the water outlet end, and a deformation direction of the spring is the same as a movement direction of the water distribution plate.

As a further improved technical solution of the present invention, the water storage device further comprises a guide shaft disposed in the water storage cavity and extending in the movement direction of the water distribution plate, and a shaft hole mating with the guide shaft is disposed through the water distribution plate.

As a further improved technical solution of the present invention, a sleeve communicated with the shaft hole and sleeved on the guide shaft is disposed on at least one side of the water distribution plate.

As a further improved technical solution of the present invention, the driving member is a spring connecting the water distribution plate with the water inlet end and/or the water outlet end, and the spring is sleeved on the guide shaft.

As a further improved technical solution of the present invention, the water distribution plate has a flat plate shape, and a plane where the water distribution plate lies is perpendicular to a movement direction of the water distribution plate.

As a further improved technical solution of the present invention, a water outlet slot communicated with the water storage cavity is disposed protrusively and outwardly on a side of the housing adjacent to the water outlet end, and wherein after the water distribution plate moves to the water outlet end, the water outlet slot is communicated with both the water inlet cavity and the water outlet cavity.

As a further improved technical solution of the present invention, the housing comprises a main body having an opening at an end and a cover for opening and closing the opening; the water storage device further comprises a water inlet tube connected to the cover.

As a further improved technical solution of the present invention, a width of the gap between the outer edge of the water distribution plate and the inner wall of the housing is in a range of 1 mm~2 mm.

To achieve the above object, the invention also provides a refrigerator, the refrigerator comprises a refrigerating compartment and the water storage device as above disposed in the refrigerating compartment.

Advantageous effects of the present invention are as follows: the water storage device of the present invention is provided with the water distribution plate which is disposed in the water storage cavity and dividing the water storage cavity into the water inlet cavity towards the water inlet end and the water outlet cavity towards the water outlet end; when water enters from the water inlet end, the incoming water can drive the water distribution plate to move towards the water outlet end; while the water distribution plate moves from the water inlet end towards the water outlet end, on the one hand, the water distribution plate presses the cold water in the water outlet cavity to flow out of the water outlet end for the user to take for use; on the other hand, the water entering the water inlet cavity from the water inlet end will not mix with the cold water in the water outlet cavity, so that the user can take water at a desired temperature.

DETAILED DESCRIPTION

Figure 1:
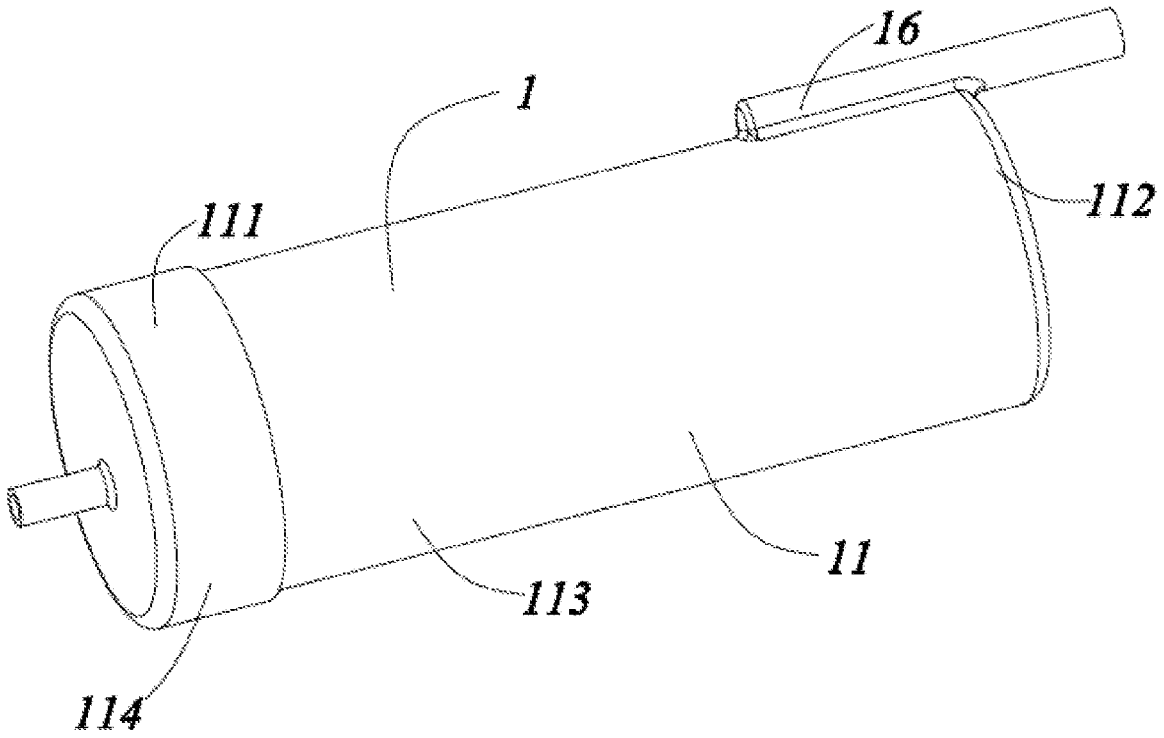
FIG. 1 is a schematic structural view of a water storage device in a first embodiment of the present invention.
Figure 2:
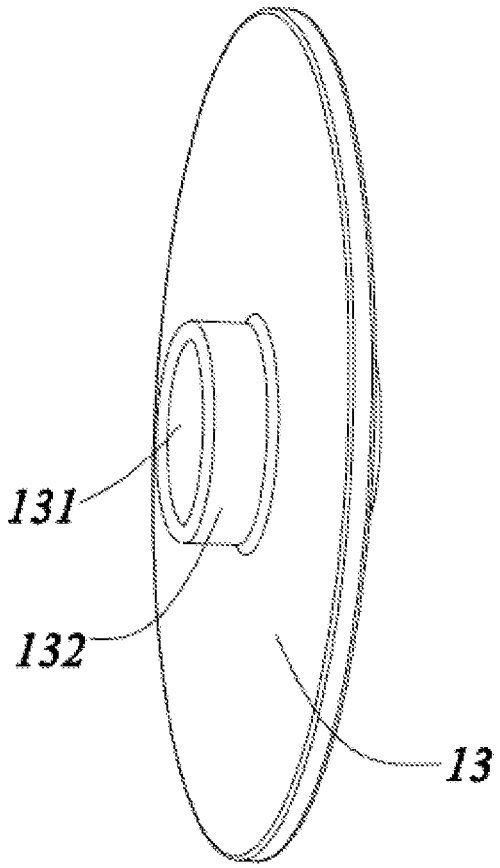
FIG. 2 is a schematic structural view showing of a water distribution plate in the water storage device shown in FIG. 1.
Figure 3:
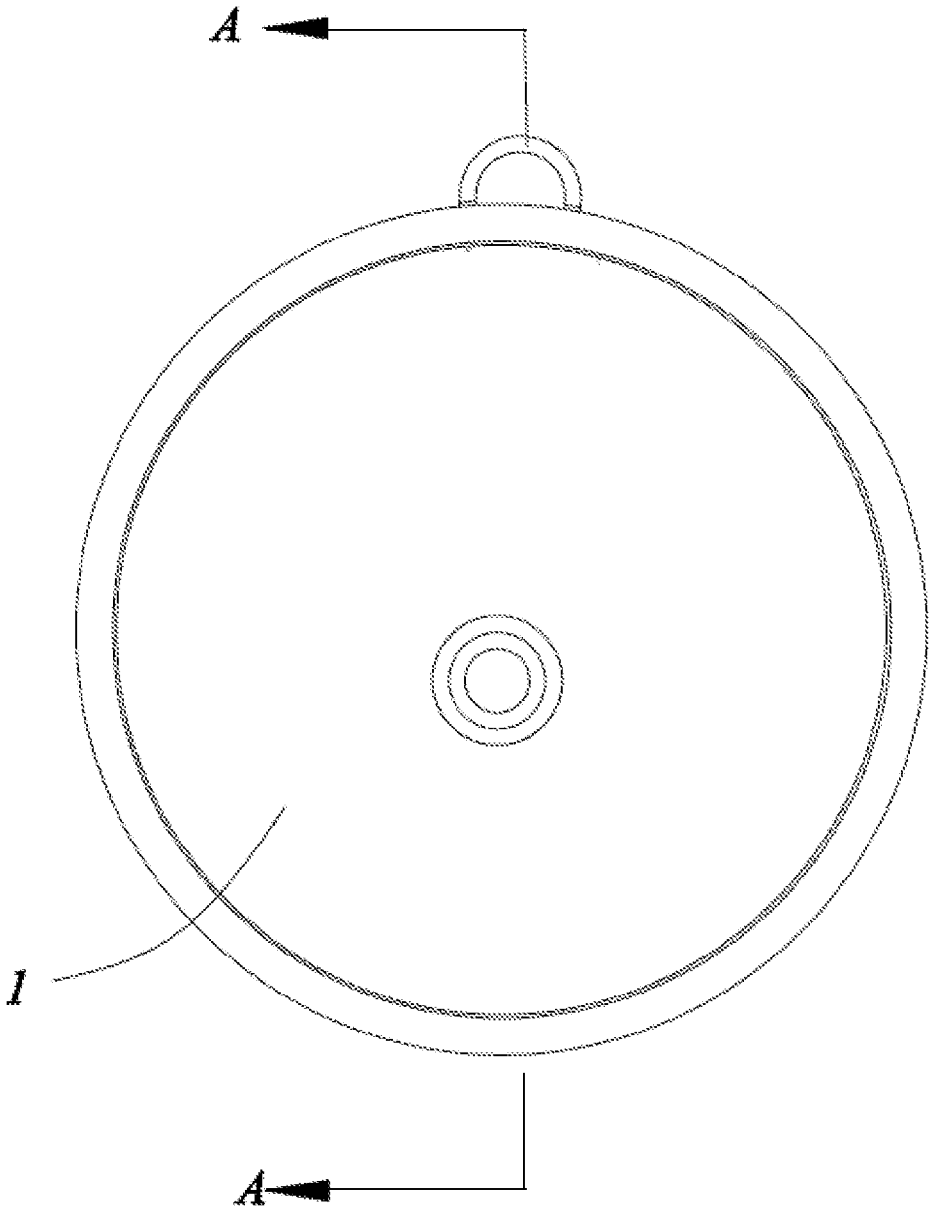
FIG. 3 is a schematic structural view of the water storage device shown in FIG. 1 as viewed from another angle.
Figure 4:
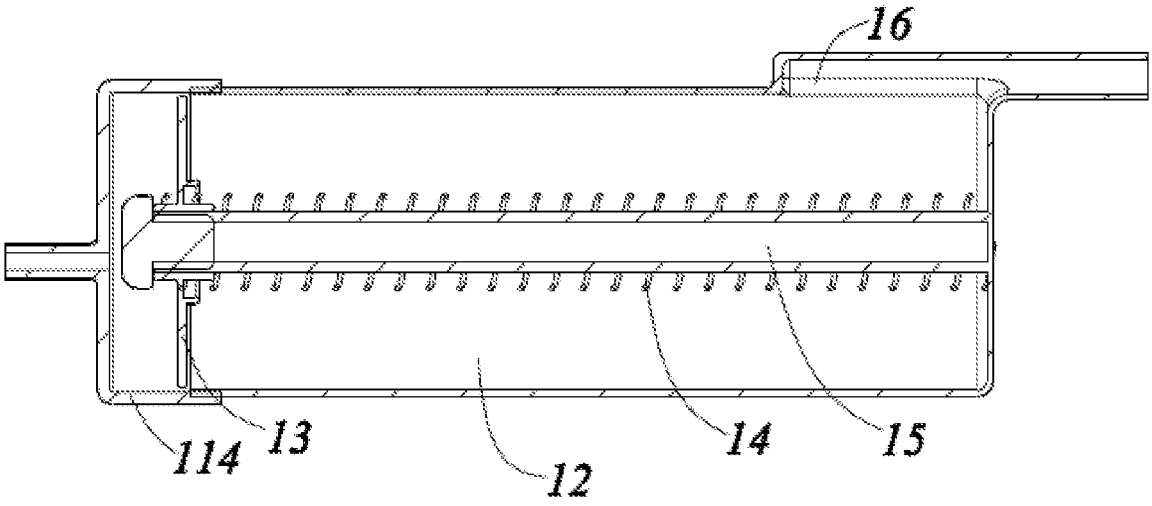
FIG. 4 is a cross-sectional view taken along a line A-A showing the water distribution plate in the water storage device shown in FIG. 3 is located at a water inlet end.
Figure 5:
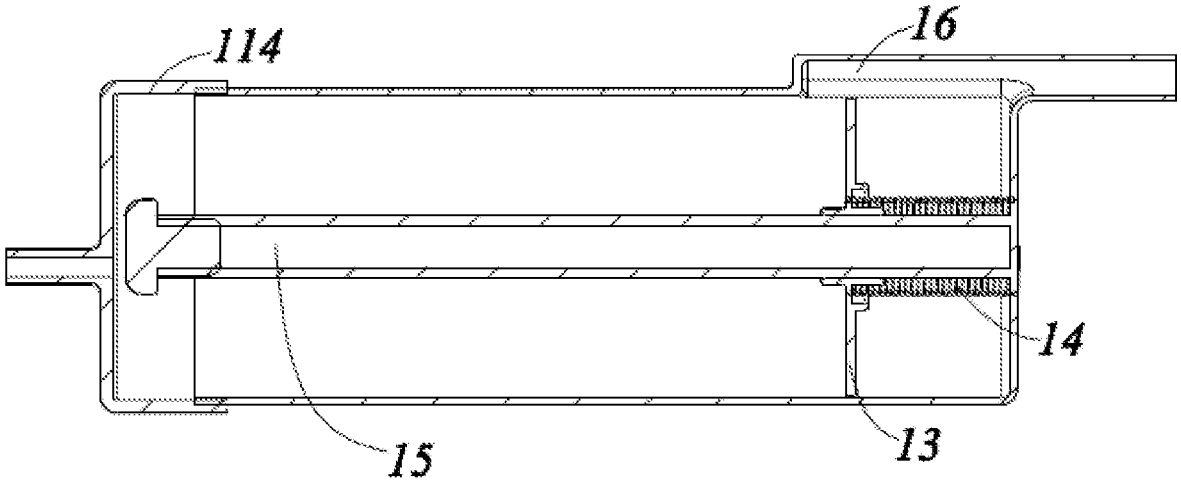
FIG. 5 is a cross-sectional view taken along a line A-A showing the water distribution plate in the water storage device shown in FIG. 3 is located at a water outlet end.
Figure 6:
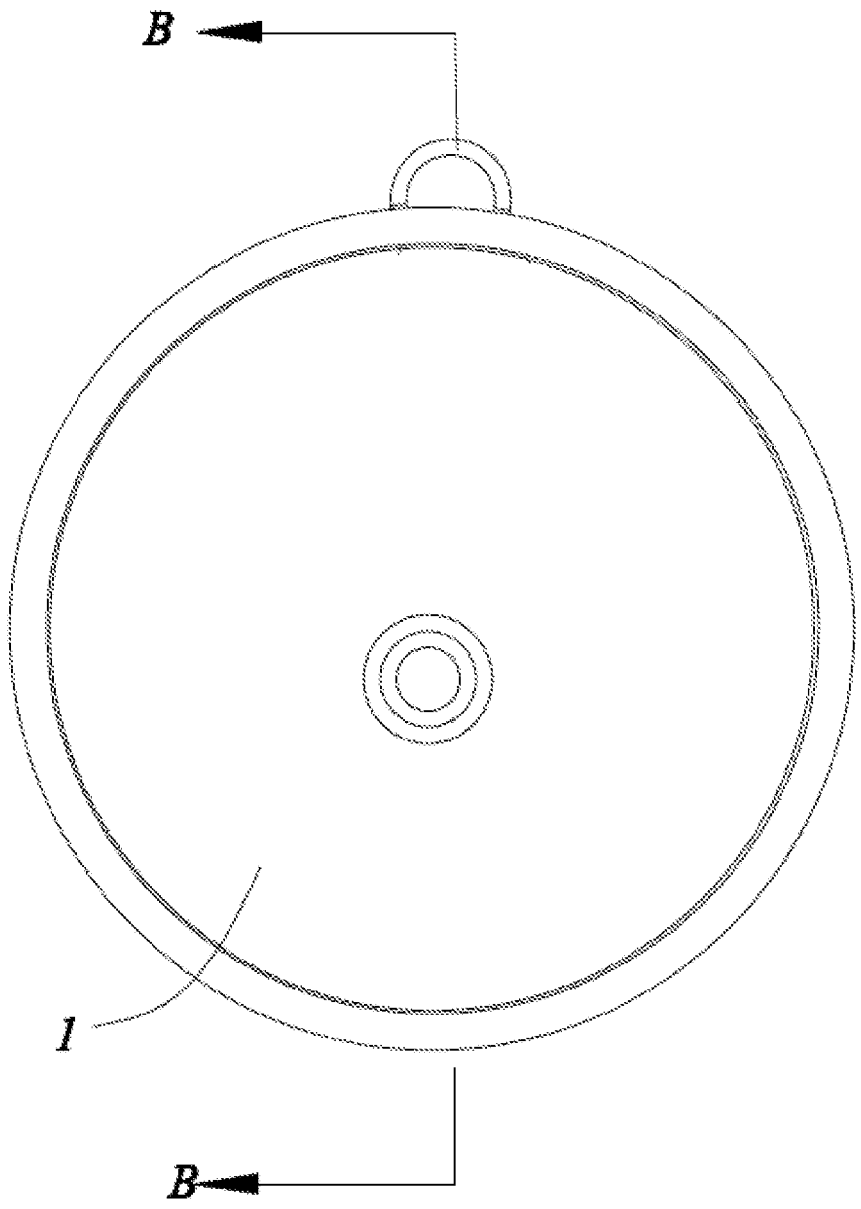
FIG. 6 is a schematic structural view of a water storage device in a second embodiment of the present invention.
Figure 7:
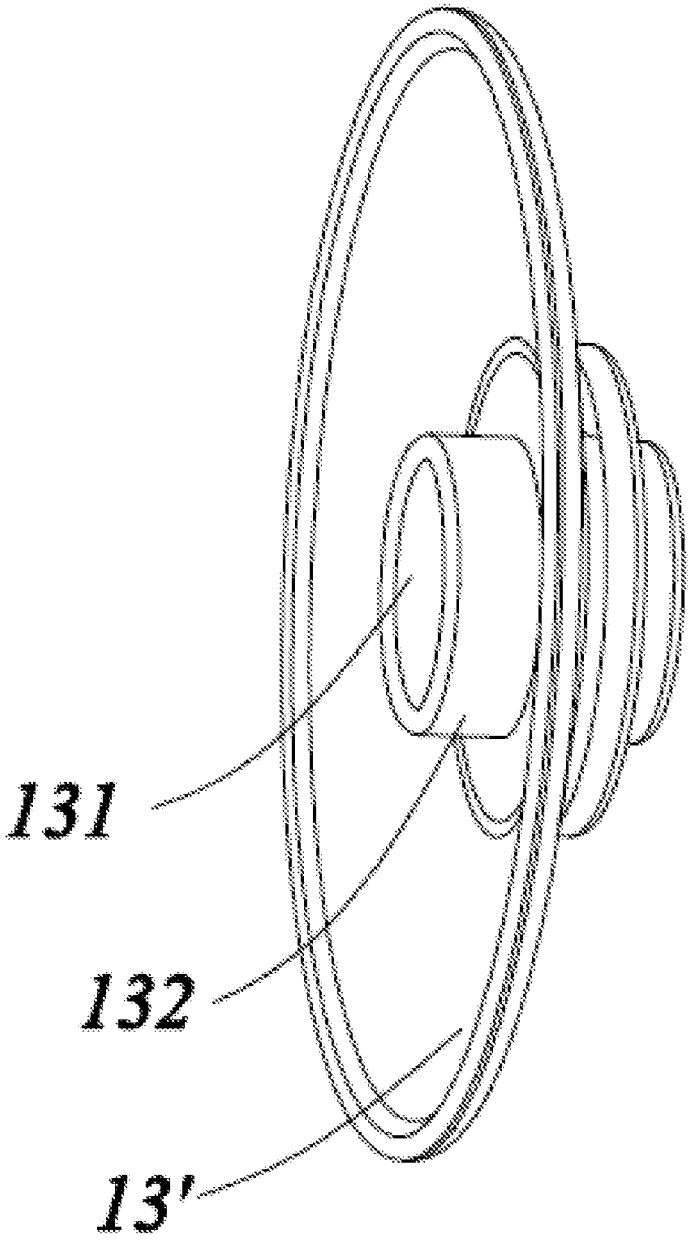
FIG. 7 is a schematic structural view of a water distribution plate in the water storage device shown in FIG. 6.
Figure 8:
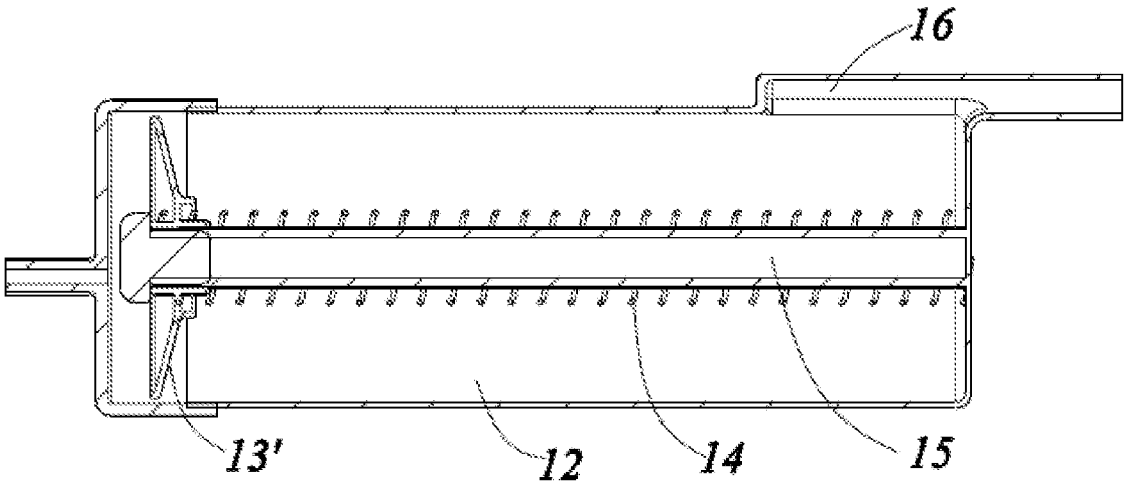
FIG. 8 is a cross-sectional view taken along a line B-B showing the water distribution plate in the water storage device shown in FIG. 6 is located at a water inlet end.
Figure 9:
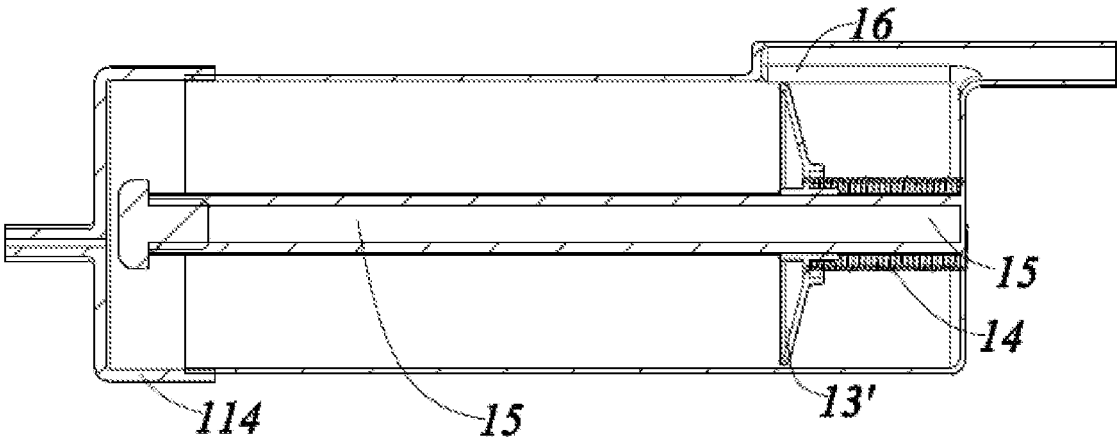
FIG. 9 is a cross-sectional view taken along a line B-B showing the water distribution plate in the water storage device shown in FIG. 6 is located at a water outlet end.

The present invention will be described below in detail in conjunction with embodiments shown in figures. Reference is made to FIG. 1 through FIG. 9 which show preferred embodiments of the present invention.

FIG. 1 through FIG. 5 show a first embodiment of the present invention. The present invention provides a water storage device 1 and a refrigerator having the water storage device 1. The refrigerator comprises a box body, a door body, a refrigerating compartment enclosed by the door body and the box body, and the water storage device 1 disposed in the refrigerating compartment. The cold in the refrigerating compartment cools the water in the water storage device 1, so that the user can take out cold water from the water storage device 1, and convenience is provided to the user.

Optionally, the refrigerator further comprises a water taking device disposed on the door body and connected with the water storage device 1, to facilitate the user to take water out of the water storage device 1 from outside of the refrigerator, which can prevent loss of the cold and save energy consumption.

The water storage device 1 comprises a housing 11 forming a water storage cavity 12, a water distribution plate 13 disposed in the water storage cavity 12, and a driving member 14.

The housing 11 has a water inlet end 111 connected with an external water source and a water outlet end 112 disposed opposite to the water inlet end. It may be appreciated that the water outlet end 112 is connected with the water taking device so that the user can take the water in the water storage device 1 from the water taking device. Certainly, when the refrigerator does not include the water taking device, the user can directly take the water in the water storage device 1 from the water outlet end 112.

Specifically, the housing 11 comprises a main body 113 having an opening at an end and a cover 114 for opening and closing the opening, to facilitate the user to clean the water storage cavity 12 and replace the water distribution plate 13.

The water storage device 1 further comprises a water inlet tube connected to the cover 114, i.e., the end where the cover 114 lies is the water inlet end 111. On the one hand, the water inlet tube can deliver water from the external water source into the water storage cavity 12; on the other hand, when the user needs to clean the water storage cavity 12 or replace the water distribution plate 13, he only needs to remove the main body 113 from the cover 114 without detaching the water inlet tube, which is relatively convenient.

The water distribution plate 13 divides the water storage cavity 12 into a water inlet cavity towards the water inlet end 111 and a water outlet cavity towards the water outlet end 112, i.e., a portion of the water storage cavity 12 located between the water distribution plate 13 and the water inlet end 111 is the water inlet cavity, and a portion of the water storage cavity 12 located between the water distribution plate 13 and the water outlet end 112 is the water outlet cavity.

The water distribution plate 13 is movable between the water inlet end 111 and the water outlet end 112. It may be appreciated that when the water distribution plate 13 moves, the water inlet cavity and water outlet cavity will change accordingly.

Upon use for the first time, the water distribution plate 13 is located at the water inlet end 111; after the user opens a valve of the water outlet end 112, the water from the external water source flows into the water inlet cavity from the water inlet end 111 at a high rate and impinges on the water distribution plate 13. On the one hand, the incoming water drives the water distribution plate 13 to move from the water inlet end 111 to the water outlet end 112, and meanwhile the water distribution plate 13 presses the cold water in the water outlet cavity to flow out from the water outlet end 112 for the user's use; on the other hand, while the water distribution plate 13 moves from the water inlet end 111 towards the water outlet end 112, the water entering the water inlet cavity from the water inlet end 111 does not mix with the cold water in the water outlet cavity so that the user can take the cold water at a desired temperature.

Specifically, in the present embodiment, the water distribution plate 13 has a flat plate shape, and a plane where the water distribution plate 13 lies is perpendicular to a movement direction of the water distribution plate 13 so that while the user takes the water, the water flowing into the water inlet cavity from the water inlet end 111 at a high rate can drive the water distribution plate 13 to move from the water inlet end 111 towards the water outlet end 112, and meanwhile, the water distribution plate 13 presses the cold water in the water outlet cavity to flow out from the water outlet end 112 for the user's use.

The driving member 14 is configured to drive the water distribution plate 13 to return to the water inlet end 111 after the water distribution plate 13 moves toward the water outlet end 112.

Furthermore, a gap allowing water to flow through is provided between the outer edge of the water distribution plate 13 and the inner wall of the housing 11. While the driving member 14 drives the water distribution plate 13 to return to the water inlet end 111 after the user finishes taking water, the water flowing into the water inlet cavity from the water inlet end 111 can flow through the gap into the water outlet cavity. On the one hand, this facilitates the driving member 14 to return the water distribution plate 13 to the water inlet end; on the other hand, after the water distribution plate 13 returns to the water inlet end 111, the water outlet cavity is in a water-full state, thereby getting ready for the user's water taking next time.

Specifically, a width of the gap between the outer edge of the water distribution plate 13 and the inner wall of the housing 11 is in a range of 1 mm~2 mm. On the one hand, this enables the water distribution plate 13 to smoothly move between the water inlet end 111 and the water outlet end 112 and can prevent the water entering the water inlet cavity from the water inlet end 111 from mixing with the cold water in the water outlet cavity while the water distribution plate 13 moves from the water inlet end towards the water outlet end 112, so that the user can take cold water; on the one hand, while the driving member 14 drives the water distribution plate 13 to return to the water inlet end 111, the water entering the water inlet cavity from the water inlet end 111 can enter the water outlet cavity through the gap, so that the driving member 14 can drive the water distribution plate 13 to return to the water inlet end, and after the water distribution plate 13 returns to the water inlet end, the water outlet cavity is in a water-full state, thereby getting ready for the user's water taking next time.

Meanwhile, a shape of the water distribution plate 13 is the same as a cross-sectional shape of the housing 11, so that the water entering the water inlet cavity from the water inlet end 111 exerts a relatively uniform impingement force on the surface of the water distribution plate 13, which enhances the stability of movement of the water distribution plate 13.

Specifically, the driving member 14 is a spring connecting the water distribution plate 13 with the water inlet end 111 and/or the water outlet end 112, and a deformation direction of the spring is the same as the movement direction of the water distribution plate 13; after the water distribution plate 13 moves from the water inlet end 111 towards the water outlet end 112, the spring acts on the water distribution plate 13 so that the water distribution plate 13 returns to the water inlet end 111.

In the present embodiment, the spring is connected to the water distribution plate 13 and the water outlet end 112. When the user takes water so that the incoming water drives the water distribution plate 13 to move from the water inlet end 111 to the water outlet end 112, the spring is in a compressed state. After the user closes the valve of the water outlet end 112, i.e., after he finishes taking water, the water distribution plate 13 stops moving towards the water outlet end 112. Under an action of a resilient restoring force of the spring, the water distribution plate 13 returns to the water inlet end 111. At the same time, while the water distribution plate 13 moves towards the water inlet end 111, the water entering the water inlet cavity from the water inlet end 111 can flow through the gap into the water outlet cavity.

Furthermore, the surface of the water distribution plate 13' towards the water outlet end 112 is not shaped the same as the surface of the water distribution plate 13' towards the water inlet end 111, namely, the surface of the water distribution plate 13' towards the water outlet end 112 is a convex arc surface, thereby facilitating the water distribution plate 13' to move from the water inlet end 111 to the water outlet end 112, driven by the incoming water.

Furthermore, a sleeve 132 communicated with the shaft hole 131 and sleeved on the guide shaft 15 is disposed on at least one side of the water distribution plate 13, to prevent a tilt phenomenon of the water distribution plate 13 when the water distribution plate 13 moves between the water inlet end 111 and water outlet end 112.

Specifically, the spring is sleeved on the guide shaft 15 to prevent the spring from tilting during deformation and enhance the stability of the movement of the water distribution plate 13.

Furthermore, a water outlet slot 16 communicated with the water storage cavity 12 is disposed protrusively and outwardly on a side of the housing 11 adjacent to the water outlet end 112. After the water distribution plate 13 moves to the water outlet end 112, the water outlet slot 16 is communicated with both the water inlet cavity and the water outlet cavity so that after the user takes water and the cold water in the water outlet cavity is used up, i.e., after the water distribution plate 13 moves to the water outlet end 112, the water entering the water inlet cavity from the water inlet end 111 can enter the water outlet cavity through the water outlet slot 16 for the user to take and use, such that the user can take water normally and the phenomenon of water supply interruption will not occur.

FIG. 6 through FIG. 9 show a second embodiment of the present invention. The second embodiment differs from the first embodiment in that a surface of the water distribution plate 13' towards the water inlet end 111 is a concave arc surface. When the user opens the valve of the water outlet end 112 to take water, the water from the external water source flows into the water inlet cavity from the water inlet end 111 at a high rate and impinges on the concave arc surface of the water distribution plate 13'. After the incoming water impinges on the concave arc surface of the water distribution plate 13', a turbulence towards the water inlet end 111 is formed, so that the water entering the water inlet cavity does not mix with the cold water in the water outlet cavity, and the anti-water mixing effect of the water distribution plate 13' is enhanced; meanwhile, this is more advantageous in facilitating the water distribution plate 13' to move from the water inlet end 11 towards the water outlet end 112, thereby pressing the cold water in the water outlet cavity to flow out of the water outlet end 112 for the user to take for use.

Furthermore, the surface of the water distribution plate 13' towards the water outlet end 112 is shaped the same as the surface of the water distribution plate 13' towards the water inlet end 111, namely, the surface of the water distribution plate 13' towards the water outlet end 112 is a concave arc surface, thereby facilitating the water distribution plate 13' to move from the water inlet end 111 to the water outlet end 112, driven by the incoming water.

Except for the above difference, the second embodiment and first embodiment are the same in other structures, which will not be detailed any more here.

To conclude, the water storage device of the present invention is provided with the water distribution plate 13, 13' which is disposed in the water storage cavity and dividing the water storage cavity into the water inlet cavity towards the water inlet end and the water outlet cavity towards the water outlet end; when water enters from the water inlet end 111, the incoming water can drive the water distribution plate 13, 13' to move towards the water outlet end; while the water distribution plate 13, 13' moves from the water inlet end 111 towards the water outlet end 112, on the one hand, the water distribution plate 13, 13' presses the cold water in the water outlet cavity to flow out of the water outlet end 112 for the user to take for use; on the other hand, the water entering the water inlet cavity from the water inlet end 111 will not mix with the cold water in the water outlet cavity, so that the user can take water at a desired temperature.

It should be understood that although the description is described according to the embodiments, not every embodiment only includes one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A water storage device, wherein the device comprises:

a housing forming a water storage cavity and having a water inlet end and a water outlet end disposed opposite to the water inlet end;

a water distribution plate disposed in the water storage cavity and configured to divide the water storage cavity into a water inlet cavity towards the water inlet end and a water outlet cavity towards the water outlet end, a gap allowing water to flow through being provided between the outer edge of the water distribution plate and the inner wall of the housing; when water enters from the water inlet end, the incoming water drives the water distribution plate to move towards the water outlet end, wherein a water outlet slot communicated with the water storage cavity is disposed protrusively and outwardly on a side of the housing adjacent to the water outlet end, and wherein after the water distribution plate moves to the water outlet end, the water outlet slot is communicated with both the water inlet cavity and the water outlet cavity;

a driving member configured to drive the water distribution plate to return to the water inlet end after the water distribution plate moves toward the water outlet end.

2. The water storage device according to claim 1, wherein the driving member is a spring connecting the water distribution plate with the water inlet end and/or the water outlet end, and a deformation direction of the spring is the same as a movement direction of the water distribution plate.

3. The water storage device according to claim 1, wherein the water storage device further comprises a guide shaft disposed in the water storage cavity and extending in the movement direction of the water distribution plate, and a shaft hole mating with the guide shaft is disposed through the water distribution plate.

4. The water storage device according to claim 3, wherein a sleeve communicated with the shaft hole and sleeved on the guide shaft is disposed on at least one side of the water distribution plate.

5. The water storage device according to claim 3, wherein the driving member is a spring connecting the water distribution plate with the water inlet end and/or the water outlet end, and the spring is sleeved on the guide shaft.

6. The water storage device according to claim 1, wherein the water distribution plate has a flat plate shape, and a plane where the water distribution plate lies is perpendicular to a movement direction of the water distribution plate.

7. The water storage device according to claim 1, wherein the housing comprises a main body having an opening at an end and a cover for opening and closing the opening; the water storage device further comprises a water inlet tube connected to the cover.

8. The water storage device according to claim 1, wherein a width of the gap between the outer edge of the water distribution plate and the inner wall of the housing is in a range of 1 mm 2 mm.

9. A refrigerator, wherein the refrigerator comprises a refrigerating compartment and the water storage device according to claim 1 disposed in the refrigerating compartment.

10. A water storage device, wherein the device comprises:

a housing forming a water storage cavity and having a water inlet end and a water outlet end disposed opposite to the water inlet end;

a water distribution plate disposed in the water storage cavity and configured to divide the water storage cavity into a water inlet cavity towards the water inlet end and a water outlet cavity towards the water outlet end, a gap allowing water to flow through being provided between the outer edge of the water distribution plate and the inner wall of the housing; when water enters from the water inlet end, the incoming water drives the water distribution plate to move towards the water outlet end;

a driving member configured to drive the water distribution plate to return to the water inlet end after the water distribution plate moves toward the water outlet end;

wherein the housing comprises a main body having an opening at an end and a cover for opening and closing the opening; the water storage device further comprises a water inlet tube connected to the cover.

* * * * *